United States Patent [19]

Shelton

[11] Patent Number: 4,458,379

[45] Date of Patent: Jul. 10, 1984

[54] CLOSURE PANEL HINGE AND HOLD OPEN MECHANISM

[75] Inventor: Alan J. Shelton, Rochester, Mich.

[73] Assignee: General Motors Corporation, Detroit, Mich.

[21] Appl. No.: 356,781

[22] Filed: Mar. 10, 1982

[51] Int. Cl.[3] ..... E05D 11/10

[52] U.S. Cl. ..... 16/297; 16/307; 16/324; 16/335; 16/349; 220/335; 292/226; 296/1 C

[58] Field of Search ..... 16/231–233, 16/279, 295–297, 304, 307, 308, 323, 324, 325, 341, 342, 376, DIG. 10, DIG. 17, 333, 335, 336, 349; 296/1 C; 292/236, 338, DIG. 15; 217/60 R, 60 B; 49/386; 220/290, 335

[56] References Cited

U.S. PATENT DOCUMENTS

| | | | |
|---|---|---|---|
| 1,715,590 | 6/1929 | Burhenne | 16/307 X |
| 2,760,811 | 8/1956 | Basferd | 296/1 C |
| 2,987,754 | 6/1961 | Widmer | 16/336 |
| 3,905,637 | 9/1975 | Smith | 296/1 C |
| 4,172,611 | 10/1979 | Krus | 296/1 C |
| 4,193,164 | 3/1980 | Okayana | 16/307 X |
| 4,236,746 | 12/1980 | La Voie | 296/1 C |
| 4,257,642 | 3/1981 | Sampson | 296/1 C |
| 4,332,055 | 6/1982 | Rudnick et al. | 16/335 |
| 4,361,354 | 11/1982 | Kemp, Jr. | 296/1 C |

OTHER PUBLICATIONS

"Product Design Manual," Oldsmobile Division, General Motors Corporation, p. 7.

*Primary Examiner*—Fred Andrew Silverberg
*Attorney, Agent, or Firm*—Charles E. Leahy

[57] ABSTRACT

A closure panel hinge and hold open mechanism includes a hinge bracket adapted for mounting on a vehicle body and a closure panel bracket. A pivot shaft pivotally mounts the closure panel bracket on the hinge bracket. A coil spring surrounds the pivot shaft and has integral first and second spring legs extending outwardly from the endmost spring coils thereof and respectively anchored on the hinge bracket and the closure panel bracket to urge the closure panel to a normal closed position relative the hinge bracket. A detent shoulder is provided on the hinge bracket and is automatically engaged by the second spring leg anchored on the closure panel when the closure panel bracket is moved from the closed position to the open position to hold the second spring leg against return movement and thereby hold the closure panel in the open position. An offset handle portion is provided on the second spring leg to enable flexure relative the closure panel bracket to disengage the spring leg from the detent shoulder so that the spring effort is restored to bias the closure panel bracket to the closed position.

1 Claim, 2 Drawing Figures

CLOSURE PANEL HINGE AND HOLD OPEN MECHANISM

The invention relates to a closure panel hinge and hold open mechanism and more particularly provide a closure spring which biases the closure panel to the closed position and has a leg which is engageable with a detent to hold the closure panel in the open position.

BACKGROUND OF THE INVENTION

It is well known in motor vehicles to mount a license plate on a closure panel which is mounted to the body by a hinge to enable movement of the closure panel between a vertical position concealing a fuel filler tube or a deck lid latch and a horizontal position enabling access thereto. Prior patents such as U.S. Pat. Nos. Krus 4,172,611, issued Oct. 30, 1979, and Basferd 2,760,811, issued June 17, 1954, provide a latch or a rod which will hold the closure panel in the open position.

SUMMARY OF THE INVENTION

A closure panel hinge and hold open mechanism includes a hinge bracket adapted for mounting on a vehicle body and a closure panel bracket. A pivot shaft pivotally mounts the closure panel bracket on the hinge bracket. A coil spring surrounds the pivot shaft and has integral first and second spring legs extending outwardly from the inmost spring coils thereof and respectively anchored on the hinge bracket and the closure panel bracket to urge the closure panel to a normal closed position relative the hinge bracket. A detent shoulder is provided on the hinge bracket and is automatically engaged by the second spring leg anchored on the closure panel when the closure panel bracket is moved from the closed position to the open position to hold the second spring leg against return movement and thereby hold the closure panel in the open position. An offset handle portion is provided on the second spring leg to enable flexure relative the closure panel bracket to disengage the spring leg from the detent shoulder so that the spring effort is restored to bias the closure panel bracket to the closed position.

The object, feature and advantage of the invention resides in the provision of a closure panel bias spring having a spring leg which is automatically engageable with a detent shoulder provided on the stationary hinge bracket so that the spring leg engages the detent shoulder to hold the closure panel in an open position.

A further object, feature and advantage of the invention resides in the provision of a handle portion at the end of a closure panel spring leg by which the spring leg may be flexed away from engagement with a detent shoulder provided on a hinge bracket pivotally connected to the closure panel to selectively disengage the flexure leg from the detent shoulder and thereby restore the spring effect to return the closure panel from a held open position to the normal closed position.

DESCRIPTION OF THE DRAWINGS

These and other objects, features and advantages of the invention will become apparent upon consideration of the specification and the appended drawings in which.

DESCRIPTION OF THE PREFERRED EMBODIMENT

Figure 1:
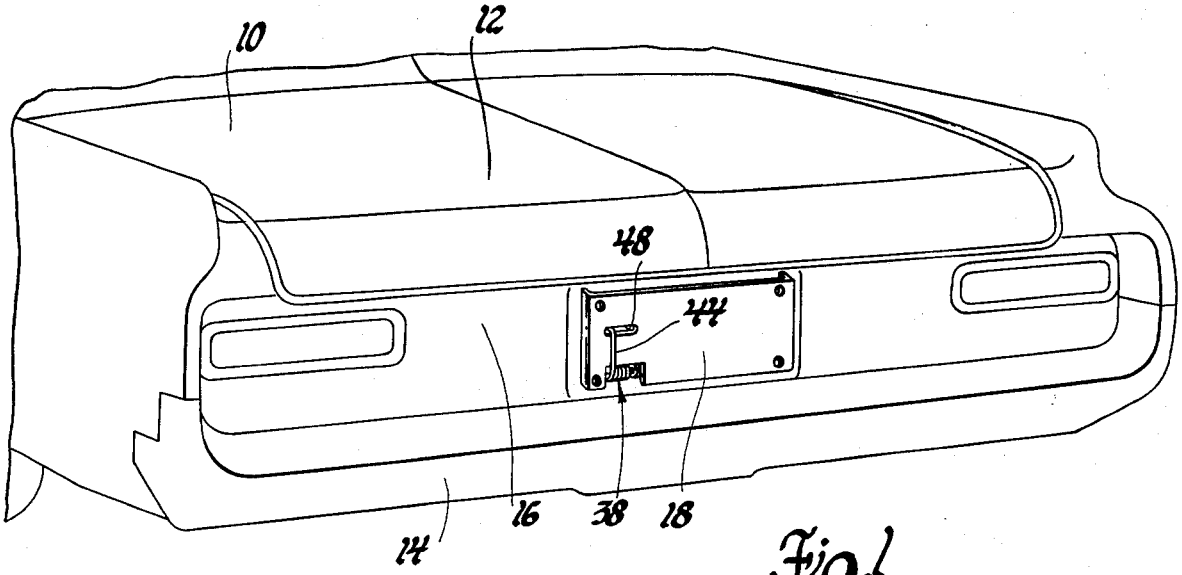
FIG. 1 is a perspective view of the rear end of a vehicle body having closure panel which conceals the gas filler neck and/or the deck lid latch and may be pivotally moved to a horizontal open position permitting access thereto.

Referring to FIG. 1, it is seen that the rear end structure of a motor vehicle body 10 includes a deck lid 12, bumper 14 and a filler panel 16. A closure panel 18 is hingedly mounted on the filler panel 16 and is spring biased to the FIG. 1 position in which the closure panel 18 conceals a fuel filler neck and/or a lock cylinder for unlatching the deck lid 12.

Figure 2:
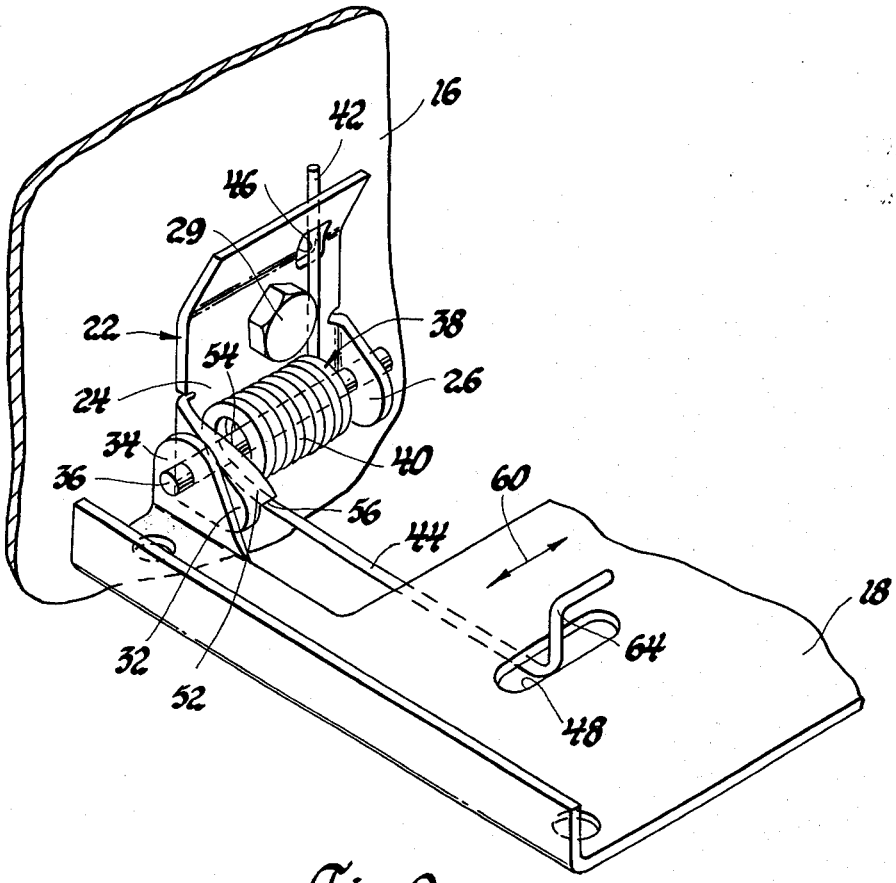
FIG. 2 is and enlarged fragmentary perspective view of the closure panel pivoted to the horizontal open position and showing the construction of the closure panel hinge and the mechanism for holding the closure panel in the open position.

Referring to FIG. 2, there is shown an enlarged fragmentary perspective view similar to FIG. 1 but showing the closure panel 18 pivoted downwardly to the horizontal open position. The hinge for mounting the closure panel 18 on the filler panel 16 includes a hinge bracket 22 of stamped metal including a generally planar base wall 24 and laterally spaced ears 26 and 32. The hinge bracket 22 is attached to the filler panel 16 by a bolt 29.

The closure panel 18 has an ear 34 which is juxtaposed with the hinge bracket ear 32. A pivot shaft 36 extends through aligned apertures provided in the closure panel ear 34 and the hinge bracket ears 26 and 32 to mount the closure panel 18 for pivotal movement between the closed position of FIG. 1 and the open position of FIG. 2.

A spring assembly 38 for biasing the closure panel 18 to the closed position of FIG. 1 is comprised of a spring coil 40 which surrounds the pivot shaft 36 and has a first spring leg 42 extending outwardly from the endmost spring coil adjacent the hinge bracket ear 26 and a second spring leg 44 which extends outwardly from the endmost spring coil adjacent the hinge bracket ear 32. The spring leg 42 extends through an aperture 46 in the base 24 of the hinge bracket 22 so that the spring leg 42 is effectively anchored to the hinge bracket 22. The spring leg 44 is suitably anchored on the closure panel 18 by having its end extend through an aperture 48 provided in the closure panel 18.

The spring assembly 38 is wound in such a manner that the spring legs 42 and 44 are biased toward one another such that the spring leg 44 anchored upon the closure panel 18 will continuously bias the closure panel 18 to the closed position. The aforedescribed closure panel hinge and spring assembly is previously known and has been successfully employed in motor vehicles.

The present invention provides a simple but effective hold open mechanism which is provided in conjunction with the aforedescribed prior known closure panel hinge and bias spring arrangement. As seen in FIG. 2, a detent structure 52 is formed integrally with the hinge bracket ear 32 and includes an inclined cam surface 54 which terminates at a detent shoulder 56. The closure panel aperture 48 which anchors the spring leg 44 is substantially elongated in the direction parallel with the axis of the pivot shaft 36 to enable flexure of the spring leg 44 in the direction of the arrow designated 60.

In operation, it will be understood that when the closure panel 18 is in the closed position of FIG. 1 the spring leg 44 will extend generally vertically in parallel relationship with the spring leg 42. When the occupant grips the closure panel 18 and initiates downward pivoting movement to access the fuel filler tube or the key cylinder for the trunk latch, the spring leg 44 will ride along the inclined cam surface 54 of the detent structure 52. When the closure panel 18 reaches the full open position of FIG. 2, the integral bias of the spring leg 44 will cause it to snap into engagement behind the detent shoulder 56 as shown in FIG. 2 so that the spring leg 44 is blocked against return movement and thereby holds the closure panel 18 in the open position of FIG. 2.

An offset handle portion 64 is provided integral with the spring leg 44 so that the spring leg 44 may be manually moved in the rightward direction as viewed in FIG. 2 to carry the spring leg 44 out of engagement with the detent shoulder 56. Accordingly, the integral spring effort acts to return the spring leg 44 and the closure panel 18 to the generally vertical position in which closure panel 18 is returned to the closed position of FIG. 1.

Thus it is seen that the invention relates to a simple and effective hold open mechanism which is provided by modification of a previously known hinge and spring arrangement.

The embodiments of the invention in which an exclusive property or privilege is claimed are defined as follows:

1. A closure panel hinge and single spring bias and hold open mechanism comprising:

a hinge bracket adapted for mounting on a vehicle body and including apertured pivot ears;

a closure panel having an apertured pivot ear;

a pivot shaft extending through the apertured ears of the hinge bracket and closure panel to mount the closure panel for pivotal movement between closed and open positions; the closure panel having an inside surface facing an inside surface of the hinge bracket;

a coil spring surrounding the pivot shaft and having first and second spring legs extending radially from the endmost coils thereof, said legs being biased about the pivot shaft toward a parallel relationship with one another;

means anchoring the first spring leg on the hinge bracket;

the second spring leg being biased apart from the first spring leg along a longitudinal axis of the shaft;

the second spring leg engaging the closure panel to bias the panel to the closed position and having an end portion extending through an elongated slot in the closure panel to the inside surface of the panel; said end portion including a first portion on the outside surface of the closure panel and a second portion on the inside surface of the closure panel;

a detent structure on one of the hinge bracket ears having a cam surface engaged by the second spring leg to limit the spreading apart of the first and second spring legs and being effective to gradually deflect the second spring leg in a direction toward the first spring leg during opening movement of the closure panel, the detent structure also including a detent shoulder engaged by the second spring leg upon the closure panel being moved to a desired open position to provide a positive stop holding the second spring leg against movement toward the first spring leg and hold the closure panel in the open position; and a handle means on the second portion of the end portion of the second spring leg to enable manual flexure of the second spring leg toward the first spring leg and out of engagement with the detent shoulder so that the bias of the second spring leg toward the first spring leg moves the closure panel to the closed position.

* * * * *